US010814382B2

(12) United States Patent
Yuan et al.

(10) Patent No.: US 10,814,382 B2
(45) Date of Patent: Oct. 27, 2020

(54) SPECIAL-SHAPED ROLL FORMED BY A COMPOSITE CASTING METHOD AND PREPARATION PROCESS THEREFORE

(71) Applicant: SHANDONG PROVINCE SIFANG TECHNICAL DEVELOPMENT GROUP CO., LTD, Jinan, Shandong (CN)

(72) Inventors: Houzhi Yuan, Shandong (CN); Ning Zhang, Shandong (CN); Xingyi Liu, Shandong (CN); Ping Wang, Shandong (CN)

(73) Assignee: SHANDONG PROVINCE SIFANG TECHNICAL DEVELOPMENT GROUP CO., LTD., Jinan (CN)

( * ) Notice: Subject to any disclaimer, the term of this patent is extended or adjusted under 35 U.S.C. 154(b) by 341 days.

(21) Appl. No.: 15/723,742

(22) PCT Filed: May 27, 2016

(86) PCT No.: PCT/CN2016/083643
§ 371 (c)(1),
(2) Date: Oct. 3, 2017

(87) PCT Pub. No.: WO2017/201729
PCT Pub. Date: Nov. 30, 2017

(65) Prior Publication Data

US 2018/0257134 A1 Sep. 13, 2018

(51) Int. Cl.
*B22D 19/16* (2006.01)
*B21B 27/02* (2006.01)
(Continued)

(52) U.S. Cl.
CPC ..... *B22D 19/16* (2013.01); *B21B 27/02* (2013.01); *B22C 9/24* (2013.01); *B22D 25/02* (2013.01);
(Continued)

(58) Field of Classification Search
CPC ..... Y10T 29/4956; Y10T 29/49565; B21D 19/16; B21B 27/02
(Continued)

(56) References Cited

U.S. PATENT DOCUMENTS 2,881,461 A * 4/1959 Wynton ..... B05C 17/0227 15/230.11
3,031,119 A * 4/1962 Allen ..... A22C 11/00 226/43
(Continued)

FOREIGN PATENT DOCUMENTS

CN 102296240 A 12/2011
CN 103028719 A 4/2013
(Continued)

*Primary Examiner* — Jason L Vaughan
(74) *Attorney, Agent, or Firm* — Oliff PLC

(57) ABSTRACT

A composite casting special-shaped roll is compounded of two parts: an inner layer and an outer layer. The shape of body of the roll is curved surface, and a center hole is arranged for mount the shaft in that central axis of roll. The casting mold is designed into two parts, namely inner cast mold and outer cast mold through the curved surface design and mold design of the roll body. The composite casting special-shaped roll with the wear-proof working layer of the roll body that is resistant to impact, rapid cooling and heating resistance and the high-strength and high-toughness core is prepared by separate casting. It meets the requirements of the service conditions of rolls used by the steel pipe and cold forming sectional steel rolling mill and other
(Continued)

equipment, improves the service life of the roll, saves the alloy material and reduces the manufacturing cost.

6 Claims, 3 Drawing Sheets

(51) Int. Cl.

| | |
|---|---|
| ***B22C 9/24*** | (2006.01) |
| ***B22D 25/02*** | (2006.01) |
| ***C22C 37/08*** | (2006.01) |
| ***C22C 37/10*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/48*** | (2006.01) |
| ***C22C 38/50*** | (2006.01) |
| ***C22C 38/56*** | (2006.01) |
| ***B21B 27/03*** | (2006.01) |
| ***C21D 6/00*** | (2006.01) |
| ***C21D 9/38*** | (2006.01) |

(52) U.S. Cl.
CPC ..... *C22C 37/08* (2013.01); *C22C 37/10* (2013.01); *C22C 38/002* (2013.01); *C22C 38/005* (2013.01); *C22C 38/02* (2013.01); *C22C 38/04* (2013.01); *C22C 38/44* (2013.01); *C22C 38/48* (2013.01); *C22C 38/50* (2013.01); *C22C 38/56* (2013.01); *B21B 27/035* (2013.01); *C21D 6/004* (2013.01); *C21D 9/38* (2013.01)

(58) Field of Classification Search
USPC ..... 492/1, 49, 60
See application file for complete search history.

(56) References Cited

U.S. PATENT DOCUMENTS 3,837,553 A * 9/1974 Bock ..... B21B 39/165 226/194
4,103,406 A * 8/1978 Ito ..... B21B 27/02 492/1
4,180,122 A * 12/1979 Sevastakis ..... B22D 11/1287 164/448
5,728,252 A * 3/1998 Kniazzeh ..... B32B 37/0053 100/176
8,171,595 B1 * 5/2012 Umhoefer, Jr. ..... B05C 17/0207 15/230.11

FOREIGN PATENT DOCUMENTS

| | | | |
|---|---|---|---|
| CN | 203917388 | U | 11/2014 |
| CN | 204934205 | U | 1/2016 |
| DE | 3248482 | A1 | 7/1984 |
| JP | H10-8211 | A | 1/1998 |

* cited by examiner

SPECIAL-SHAPED ROLL FORMED BY A COMPOSITE CASTING METHOD AND PREPARATION PROCESS THEREFORE

TECHNICAL FIELD

The invention relates to a roll casting technology, specifically a preparation method of special-shaped roll adopting a composite structure casting method. The preparation method adopts a double-liquid double outer mold casting method to prepare a special-shaped roll for production of steel pipe and a cold forming sectional steel.

BACKGROUND TECHNOLOGY

The sizing mill roll (i. e. a sizing roll), the stretch-reducing mill roll (i. e. a stretch-reducing roll) for the production of seamless steel pipe, cross roll straightening machine roll for steel pipe and steel rod (i. e. a straightening roll) in the special-shaped roll for the production of steel pipe and cold forming sectional steel, as well as most rolls in welded steel pipe unit and some rolls in the cold forming sectional steel unit, all of the above rolls are curved surface-shaped rolls with big diameters at both ends of the rolls and small middle diameters of the rolls. The structure of such special-shaped roll is the separation type of roll and shaft, which means there are middle holes, and it is used by installing on the rack after a shaft is installed in the middle hole.

The above-mentioned special-shaped rolls are the workpieces with the largest consumption in the production process of seamless steel pipe, welded steel pipe, and cold forming sectional steel. They are subjected to rolling and sliding friction under a large compressive stress, and undertake the repeated impact from the head and tail of rolled material. Some of them are subjected to rapid heating and cooling action of high-temperature rolling material and cooling water.

These special-shaped rolls can be divided into two categories by the usage temperature. One type is the rolls used under low temperature, such as straightening roll, welded steel pipe roll and cold forming sectional steel roll, etc, which are generally used at room temperature. Being used on heat treatment line, the straightening roll shall bear the rolled material temperature of 400° C.~500° C. The welded extruding roll of welded steel pipe and cold rolled steel shall bear the high temperature effect during the welding of rolled material. Meanwhile, both of them are subjected to chilling effect by cooling water. Another type is the rolls used under high temperature, such as sizing roll and stretch-reducing roll. The temperature of rolled material generally ranges from 800° C. to 1100° C.

The above-mentioned special-shaped rolls need to be repaired by repeated lathing and grinding in use. Therefore, the special-shaped rolls are required to have a sufficient thick working layer with the characteristics of abrasion resistance, impact resistance and rapid cooling and heating resistance, and should be combined with high strength and high toughness cores. The special-shaped roll under the ideal condition is a bimetal composite structure that satisfies two different requirements. But at present, the above-mentioned rolls are made of single metal, so it is difficult to take into account the requirements that two different performances are required for a special-shaped roll.

The above-mentioned straightening roll, welded steel pipe roll and cold-bend steel roll have various specifications, and there is a small amount with the same specification. For most drawings, one drawing only makes 1-2 pieces. The piece weight of the finished rolls ranges from over 10 tons to less than 1 kg. At present, forging D2 (X155 CrVMo12-1, SKD11) cold working die steel and forging H13 (X40CrMoV5-1, SKD61) hot working die steel are commonly used in the international technology field to manufacture the special-shaped roll. The forging process is free forging cylinder. All the pass and inner holes are obtained by machining. The material utilization rate is below 50%. At the same time, because the alloy content of the die steel is high, the forging and heat treatment are difficult and the process requirement is strict, the bimetal structure cannot be realized. In addition, the materials and the energy consumption are large, generating high production costs.

High-alloy ductile iron (typically Ni3Mo1) is commonly used for the above-mentioned sizing roll and the stretch-reducing roll. High content of alloying elements such as Ni, Mo and Cr are added to the nodular cast iron to improve the wear resistance of the nodular cast iron roll. However, anti-spheroidization elements such as Cr and Mo are also added, so the overall spheroidization level tends to be reduced. Since the sizing roll and the stretch-reducing roll are the thick and large ductile iron with inhomogeneous wall thickness and the isothermal quenching is difficult, the conventional normalization process is used to obtain the bainitic structure with higher content of alloy elements such as Ni, Cr, Mo. However, if the normalizing process is used to the same workpiece, its strength and toughness are much lower than that of the isothermal quenching workpiece, and it is easy to crack and break when the thickness of the remaining wall becomes thinner.

Although the sizing roll and the stretch-reducing roll of the bimetal structure can also be obtained by centrifugal casting, the centrifugal casting has the following limitations: e.g. a metal mold needs to be manufactured. When manufacturing the sizing roll and the stretch-reducing roll with smaller piece weight, it is necessary to make multiple sets of molds and more than one centrifuge is required to work at the same time, which greatly increases the production costs. The centrifugal casting is difficult because the wall thickness of sizing roll and stretch-reducing roll is large, that is, the diameter difference between the outer diameter of the roll and the inner hole is large. The curved surfaces with large diameter at both ends and small middle diameter cannot be realized by centrifugal casting, which means the casted curved surface cannot be lifted out from the centrifugal metal mold. Therefore, the cylinder can only be centrifugally cast and then processed, which greatly improves that processing and material consumption of the roll.

If the whole profiling blank and the conventional casting method are adopted for the above-mentioned special-shaped roll, the middle part with a small diameter is easy to solidify first, so that the lower part will not be fed sufficiently, becoming the defective product.

Content of Invention

The present invention provides a special-shaped roll formed by a composite casting method for manufacturing the special-shaped roll used for steel pipe mill and cold-bending section mill and other equipments, and provides a simple and practicable casting method of using a two-molten metal two-cast mold to manufacture a special-shaped roll that can ensure the quality at the same time, and the casting special-shaped roll and preparation process therefore. The technical scheme of the special-shaped roll formed by a composite casting method according to the present invention is shown as follows:

The present invention relates to a special-shaped roll formed by a composite casting method which roll body has a large diameter at two ends of the special-shaped roll, a small middle diameter of the special-shaped roll and a shape of a curved surface. The curved surface is composed of two parts of an inner layer and an outer layer. A composite bonding layer of the inner layer and the outer layer has an inner curved surface which is bent inward and has a diameter that is gradually reduced from the bottom to the top. There is a central hole along the central axis of roll that is used when installing the shaft.

The special-shaped roll formed by a composite casting method of the present invention adopts two composites and the double-fluid and double outer mold casting method. The steps are shown as follows:

designing a blank having an outer curved surface, an upper end face, and a lower end face according to an outer curved surface, an upper end face, and a lower end face of a finished roll plus machining allowances, wherein:

according to the outer curved surface of the blank, a shape of a central hole of the blank is designed as an inner curved surface which bends inward and has a diameter that is gradually reduced from a bottom to a top of the central hole, the blank is designed as two parts that constitute an inner layer of the blank and an outer layer of the blank, a shape of a composite combination layer of the outer layer of the blank and the inner layer of the blank has an inner curved surface which is bent inward and has a diameter that is gradually reduced from the bottom to the top of the composite combination layer, and from the bottom to the top of the blank, a section area of the inner layer of the blank and the outer layer of the blank gradually increases or keeps uniform while a diameter of a division curved surface at an intersection of the inner layer of the blank and the outer layer of the blank gradually decreases with a smooth transition;

providing a cast mold that is designed according to a shape of the outer curved surface and the central hole of the blank and the machining allowances, wherein:

the cast mold comprises an inner cast mold and an outer cast mold, the outer cast mold comprises an outer cast mold of the inner layer of the blank and an outer cast mold of the outer layer of the blank, a cavity space of the inner layer of the blank formed by combination of the inner cast mold and the outer cast mold of the inner layer of the blank is designed according to a shape and size of the inner layer of the blank, and a composite combination layer cavity space formed by combination of the outer cast mold of the outer layer of the blank and the inner cast mold is designed according to a shape and size of a combination of the inner layer of the blank and the outer layer of the blank;

separately smelting two kinds of molten metal for the inner layer of the blank and the outer layer of the blank at the same time;

firstly assembling the outer cast mold of the inner layer of the blank and the inner cast mold by sleeving the outer cast mold of the inner layer of the blank onto the inner cast mold from above down to form the cavity space of the inner layer of the blank, and sealing the cavity space of the inner layer of the blank;

then pouring molten metal of the inner layer of the blank into the cavity space of the inner layer of the blank;

after solidification of the molten metal of the inner layer of the blank, moving the outer cast mold of the inner layer of the blank away and rapidly mounting the outer cast mold of the outer layer of the blank to form a cavity of the outer layer of the blank and sealing the cavity of the outer layer of the blank;

then pouring the molten metal of the outer layer of the blank into the cavity of the outer layer of the blank;

after the molten metal of the outer layer of the blank solidifies, moving the outer cast mold of the outer layer of the blank away; and carrying out machining and heat treatment processes to the blank.

The special-shaped roll formed by a composite casting method adopts two two composites to cast different materials. One is the composite material wherein the outer layer of the blank is high chromium cast iron and the inner layer of the blank is cast steel, the mass percentage of the said composite material is as following: For the high chromium cast iron: C: 2.0%~2.6%, Si: 0.2%~0.5%, Mn: 0.6%~1.0%, Cr: 11.0%~18.0%, Ni: 0.5%~1.5%, Mo: 0.5%~1.5%, W: 0.5%~1.5%, Zr: 0.1%~0.3%, Nb: 0.05%~0.15%, Ti: 0.05%~0.15%, RE: 0.05%~0.15%, P: ≤0.030%, S: ≤0.025%, the rest compositions are Fe and unavoidable impurities. The content of Mo+W+Zr is greater than or equal to 1.2% and less than or equal to 2.2% by mass percent; the content of Nb+Ti+RE is greater than or equal to 0.10% and less than or equal to 0.40% by mass percent. The mass percentage of Mo, W and Zr in total is greater than or equal to 1.2% and less than or equal to 2.2%, while the mass percentage of Nb, Ti and RE in total is greater than or equal to 0.10% and less than or equal to 0.40%. The cast steel is cast carbon steel or low alloy cast steel.

The other type is the composite material wherein the outer layer of the blank is alloy nodular cast iron and the inner layer of the blank is ductile cast iron. The mass percentage of out layer of alloy nodular cast iron is: C: 3.0%~3.8%, Si: 1.4%~1.8%, Mn: ≤0.35%, Ni: ≤2.5%, Cu: 0.4%~1.0%, Mo: 0.3%~1.0%, Cr: 0.1%~0.3%, B: ≤0.08%, Mg: 0.04%~0.10%, Bi: 0.0004%~0.0005%, Sb: 0.0002%~0.0003%, P: ≤0.04%, S: ≤0.02%, the rest compositions are Fe and unavoidable impurities; Wherein, the mass percentage of Ni and Cu in total is greater than or equal to 0.4% and less than or equal to 2.5%, while the mass percentage of Cr and B in total is greater than or equal to 0.05% and less than or equal to 0.25%. The mass percentage of ductile cast iron is: C: 3.0%~3.8%, Si: 2.2%~2.7%, Mn: ≤0.35%, Cu: 0.4%~0.6%, Mg: 0.04%~0.10%, P: ≤0.04%, S: ≤0.02%, the rest compositions are Fe and unavoidable impurities. And the isothermal quenching heat treatment is carried out when the alloy nodular cast iron is adopted.

The casting special-shaped roll and its preparation method in the present invention are to adopt a kind of special-shaped roll made of metallic material. It is characterized that the roll barrel curved surface is with large diameter of two ends of the roll and small mid diameter of the roll, and there is a central hole along the central axis of the roll. The casting special-shaped roll is prepared by the following steps:

designing a blank having an outer curved surface, an upper end face, and a lower end face according to an outer curved surface, an upper end face, and a lower end face of a finished roll plus machining allowances, wherein:

according to the outer curved surface of the blank, a shape of a central hole of the blank is designed as an inner curved surface which bends inward and has a diameter that is gradually reduced from a bottom to a top of the central hole, and from the bottom to the top of the blank, section areas of the above two designs of the blank gradually increases or keeps uniform.

providing a cast mold that is designed according to a shape of the outer curved surface and the central hole of the blank and the machining allowances, wherein:

the cast mold comprises an inner cast mold and an outer cast mold, the inner cast mold is formed by an inner curved surface which is bent inward and has a diameter that is gradually reduced from the bottom to the top of the blank and a lower end face, the outer cast mold is formed by an outer curved surface of the blank which is bent inward and has a diameter that is gradually reduced from the bottom to the top of the blank and an upper end face;

smelting a single molten metal;

firstly assembling the outer cast mold and the inner cast mold, by sleeving the outer cast mold onto the inner cast mold from above down to form a cavity space of the blank, and sealing the cavity space of the blank;

then pouring the single molten metal into the cavity space of the blank;

after solidification of the molten metal, moving the outer cast mold away; and carrying out machining and heat treatment processes to the blank.

The present invention can be applied to rolls for welded steel pipe mill, cold-bend section mill, steel pipe straightener, sizing mill for hot-rolled seamless steel pipe, the stretch-reducing mill and other equipment.

The special-shaped roll formed by a composite casting method of the present invention and the casting special-shaped roll prepared by the single metal material of the present invention obtain the working layer of the roll body with the characteristics of abrasion resistance, resistant to impact, rapid cooling and heating resistance and obtain the high-strength and high-toughness core. The requirements for the service conditions of rolls used by the welded steel pipe roll and cold-bend section mill are satisfied. At the same time, the service life of rolls is extended; the manufacturing cost of the roll is reduced, and the economic efficiency for the production of the welded steel pipe and the cold-bend section steel and other products are improved.

SPECIFIC EMBODIMENTS

Figure 1:
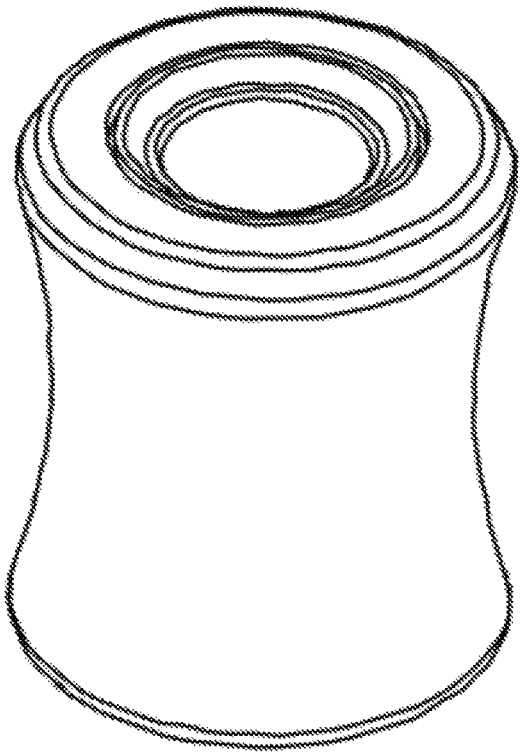
FIG. 1 is a structural diagram of a steel pipe straightener roll, and the structural diagram of the special-shaped roll with a large diameter of two ends of the roll and a small mid diameter of the roll and a central hole.
Figure 2:
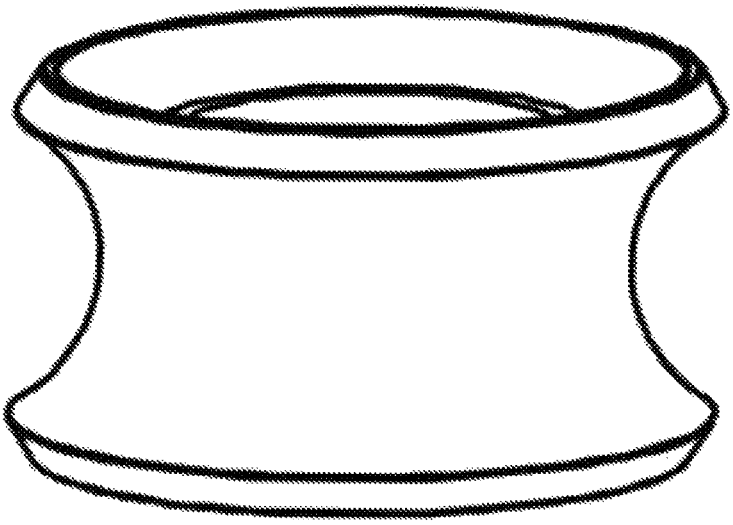
FIG. 2 is a structural diagram of roll for the steel pipe mill and cold forming sectional steel mill with a large diameter at two ends, a small mid diameter, and a central hole.

The present invention is described in detail below with reference to the design idea, the exemplary embodiments and the accompanying figures.

The special-shaped rolls involved in the invention are the curved-surface type and special-shaped rolls with large diameters of two ends of the rolls and small mid diameters of the rolls. The structure of such special-shaped roll is the separation type of roll and shaft, which means there are central holes, and it is used by installing on the rack after a shaft is installed in the central hole. The special-shaped rolls are subjected to friction and impact under a large compressive stress in the production equipment of steel pipes and cold-bend section steel, and undertake the rapid heating and cooling action of high-temperature rolling material and cooling water. At the same time, it will be repaired by repeated lathing and grinding in use. Thus, the roll is required to have a sufficiently thick working layer to meet the special requirements of adverse conditions. Namely, in the case of saving material and processing costs, the casting method should be designed according to the quality requirements of curved surface rolls with large diameters of two ends and small mid diameters. Such special-shaped rolls are also required to equip with a sufficiently thick working layer with a high strength, high toughness core. The special-shaped roll under the ideal condition is a bimetal composite structure that satisfies two different requirements. Thus, the present invention provides a simple and practical two-molten metal two-cast mold casting method with guarantee quality for the preparation of the composite structure of the shaped roll. At the same time, the casting method with guarantee quality of special-shaped roll is provided for the single-metal casting the special-shaped roll.

The casting method of the present invention is more similar to the finished product than the forging method, and more alloying elements can be added compared with the forging forming method, thereby improving the technical performance of the roll. Since the casting method can greatly save materials and energy and improve the service life of the roll for steel pipe production, the casting method can more and more meet the demand of steel pipe industry and further promotes the technical progress of the casting industry.

Referring to FIGS. 1 to 6, the design idea of the present invention is embodied by the specific implementation of the following technical solutions.

The invention relates to a technical scheme of a composite casting special-shaped roll. The body of the roll is a curved surface with a large diameter of two ends of the roll and a small mid diameter of the roll. The curved surface is composed of two parts of the inner layer and the outer layer. A shape of a composite combination layer of the outer layer of the roll and the inner layer of the roll has an inner curved surface which is bent inward and has a diameter that is gradually reduced from the bottom to the top of the roll. There is a central hole along the central axis of roll that is used when installing the shaft.

The composite casting special-shaped roll of the present invention is realized by the two-molten metal and two-cast mold casting method and the steps.

Figure 3:
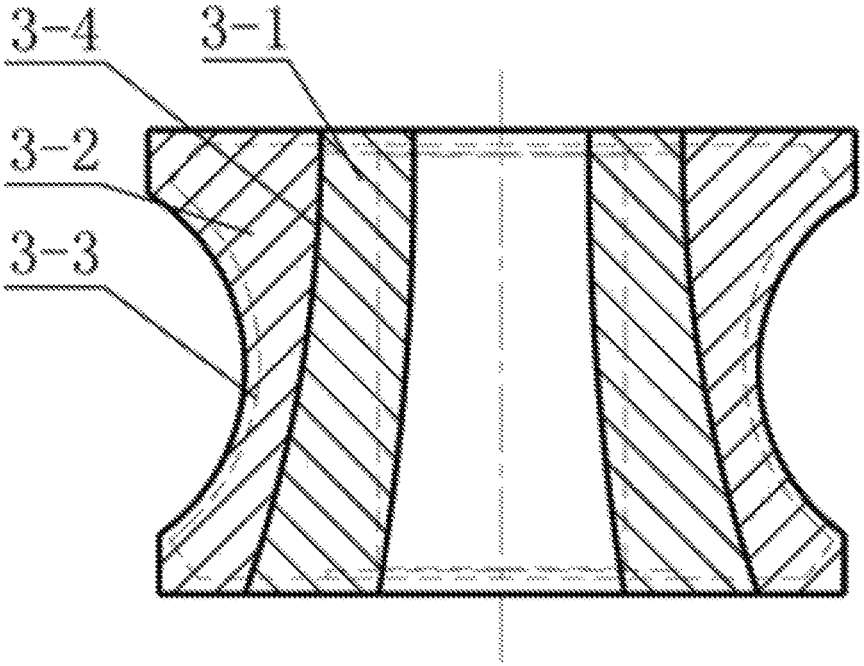
FIG. 3 is a schematic cross-sectional view of the design of the roll cast blank, in FIG. 3, 3-1 is the inner layer; 3-2 is the outer layer; 3-3 is the actual required finished product indicated by the dashed line, and 3-4 is the division curved surface at an intersection of the inner layer of the blank and the outer layer of the blank.

Referring to FIG. 3, designing a blank having an outer curved surface, an upper end face, and a lower end face according to an outer curved surface, an upper end face, and a lower end face of a finished roll plus machining allowances, wherein:

according to the outer curved surface of the blank, a shape of a central hole of the blank is designed as an inner curved surface which bends inward and has a diameter that is gradually reduced from a bottom to a top of the central hole, so that the cross-sectional area of the entire blank gradually increases or substantially keeps the consistent shape, which allows the progressive solidification without casting defects during the casting. Thus, the problems of casting defects in the conventional casting method are solved.

According to the requirement of working layer thickness required by the specific working conditions, the blank is designed as inner layer and outer layer, and the composite combination layer of outer layer 3-2 and inner layer 3-1 has an inner curved surface which is bent inward and has a diameter that is gradually reduced from the bottom to the top of the blank, the diameter of designed division curved surface 3-4 at an intersection of the inner layer of the blank and the outer layer of the blank gradually decreases from the bottom up with smooth transition to ensure mold unloading smoothly. The thickness of the outer layer of the blank can be increased by 5 mm~20 mm on the basis of the reserved machining allowances, so as to fully guarantee the amount of repair when the rolls being remachined. In order to ensure the quality of metallurgical bonding of the inner layer and the outer layer of the blank, a weight ratio of the outer layer and inner layer of the blank is designed to equal to or be more than 1.2:1. In the blank design, the division curved surface 3-4 at an intersection of the inner layer of the blank and the outer layer of the blank disappears after the casting melting into one, forming the composite bonding layer that which is formed by the melting together of two kinds of metals of the outer layer and inner layer. The broken line 3-3 in FIG. 3 illustrates the finished roll products actually required, and the central hole of the finished roll is machined into a cylindrical central hole.

Figure 4:
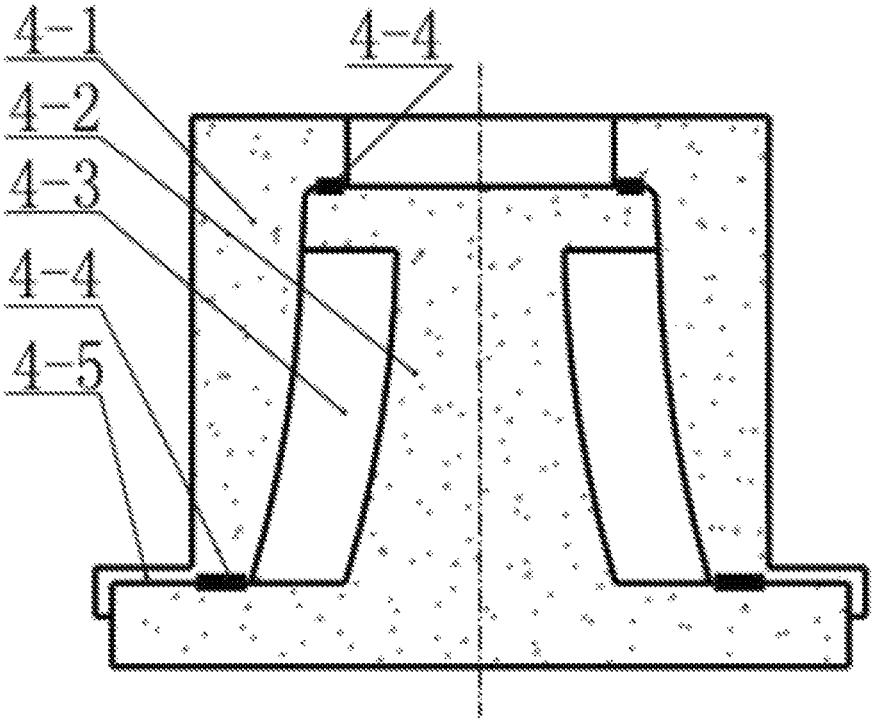
FIG. 4 is a cross-sectional schematic view of assembling the inner cast mold and the outer cast mold of the inner layer of the blank in the roll cast mold, in FIG. 4, 4-1 is the outer cast mold of the inner layer of the blank; 4-2 is the inner cast mold; 4-3 is the cavity of the inner layer of the blank; 4-4 is the sealing device; 4-5 is the cast positioning device.
Figure 5:
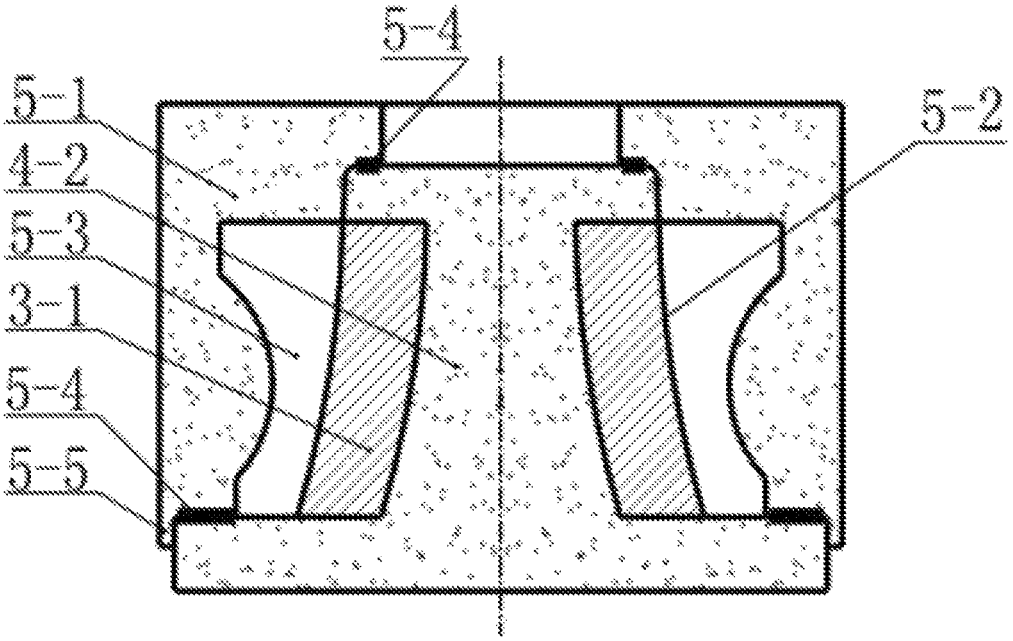
FIG. 5 is an assembled cross-sectional view of assembling the inner layer of the blank and the outer cast mold of the outer layer of the blank in the roll cast mold, in FIG. 5, 5-1 is the outer cast mold of the outer layer of the blank; 5-2 is the division curved surface at an intersection of the inner layer of the blank and the outer layer of the blank; 5-3 is the cavity of the outer layer of the blank; 5-4 is the sealing device; 5-5 is the cast positioning device; 3-1 is the inner layer that has been casted, and 4-2 is the inner cast mold.

Referring to FIG. 4 and FIG. 5, providing a cast mold that is designed according to a shape of the outer curved surface and the central hole of the blank and the machining allowances, wherein:

the cast mold comprises an inner cast mold and an outer cast mold, the outer cast mold comprises an outer cast mold of the inner layer of the blank and an outer cast mold of the outer layer of the blank, a cavity space of the inner layer of the blank formed by combination of the inner cast mold 4-2 and the outer cast mold of the inner layer of the blank 4-1 is designed according to a shape and size of the inner layer of the blank, and a composite combination layer cavity space formed by combination of the outer cast mold of the outer layer of the blank 5-1 and the inner cast mold is designed according to a shape and size of a combination of the inner layer of the blank and the outer layer of the blank;

the outer cast mold is sleeved onto the inner cast mold from above down, the outer cast mold of the inner layer of the blank 4-1 and the inner cast mold 4-2 is assembled to form the cavity space of the inner layer of the blank 4-3. After the outer cast mold of the outer layer of the blank 5-1 is assembled with the pouring and solidified inner layer 3-1 and the inner cast mold 4-2, the cavity of the outer layer of the blank 5-3 is formed. The boundary curved surface of solidified inner layer 3-1 forms the the division curved surface at an intersection of the inner layer of the blank and the outer layer of the blank 5-2, thereby forming the entire blank mold.

At the same time, two kinds of molten metal for the inner layer of the blank and the outer layer of the blank is smelted when smelting the special-shaped roll. The composites used in smelting are designed for two kinds for casting the products with different materials. One is the composite material wherein the outer layer of the blank is high chromium cast iron and the inner layer of the blank is cast steel, and the other type is the composite material wherein the outer layer of the blank is alloy nodular cast iron and the inner layer of the blank is ductile cast iron. These two composite materials can make the casting shrinkage of the inner layer of the blank and outer layer of the blank same or similar with each other, making the solidification bonding rate of the inner layer of the blank and outer layer of the blank uniform.

During the casting, firstly assembling the outer cast mold of the inner layer of the blank 4-1 and the inner cast mold 4-2, by sleeving the outer cast mold of the inner layer of the blank 4-1 onto the inner cast mold 4-2 from above down to form the cavity of the inner layer of the blank 4-3, Seal the cavity of the inner layer of the blank 4-3 by the sealing device 4-4 and the cast positioning device 4-5. Then pouring molten metal of the inner layer of the blank into the cavity space of the inner layer of the blank 4-3; after solidification of the molten metal of the inner layer of the blank, moving the outer cast mold of the inner layer of the blank away when the solidification temperature of the metal is maintained at 850° C.-950° C. and rapidly mounting the outer cast mold of the outer layer of the blank 5-1 to form a cavity space of the outer layer of the blank 5-3 with the pouring and solidified inner layer 3-1 and the inner cast mold 4-2 and sealing the cavity space of the outer layer of the blank 5-3 well by 5-4 and 5-5, and then pouring the molten metal of the outer layer of the blank into the cavity space of the outer layer of the blank 5-3, after the molten metal of outer layer of the blank solidifies, moving the outer cast mold of the outer layer of the blank 5-1 away then finish the casting process of special-shaped roll. Since the molten metal of the outer layer of the blank is poured into the cavity when molten metal of the inner layer of the blank has been solidified and still keeps the temperature at 850-950° C., the composite bonding layer where two metals on the outer layer and inner layer mutually melt are formed. A temperature detector is arranged in the sand mold of the cast mold, and the metal solidification temperature of the inner layer of the blank can be obtained by the temperature detector. The casting with a piece weight of less than 500 kg can also be judged by detecting the temperature of the metal liquid in the dead head. Since the cross-sectional area of the designed inner layer of the blank and the outer layer of the blank gradually increases or substantially keeps uniform from bottom to top, the molten metal is solidified in order, thus obtaining the ideal bimetal composite casting roll blank.

The present invention can also modify the roll with a small residual ratio after many times of reconditioning into the single metal roll blank. The inner cast mold is assembled with the outer cast mold of the outer layer of the blank, and the progressive solidification can be realized to obtain the ideal roll blank only by smelting and casting the molten metal of the outer layer of the blank. In the same way, the roll with light piece weight or high requirements for the thickness of the working layer can be modified into the single metal roll blank, which simplifies the production process and ensures the quality of the casting blank.

Figure 6:
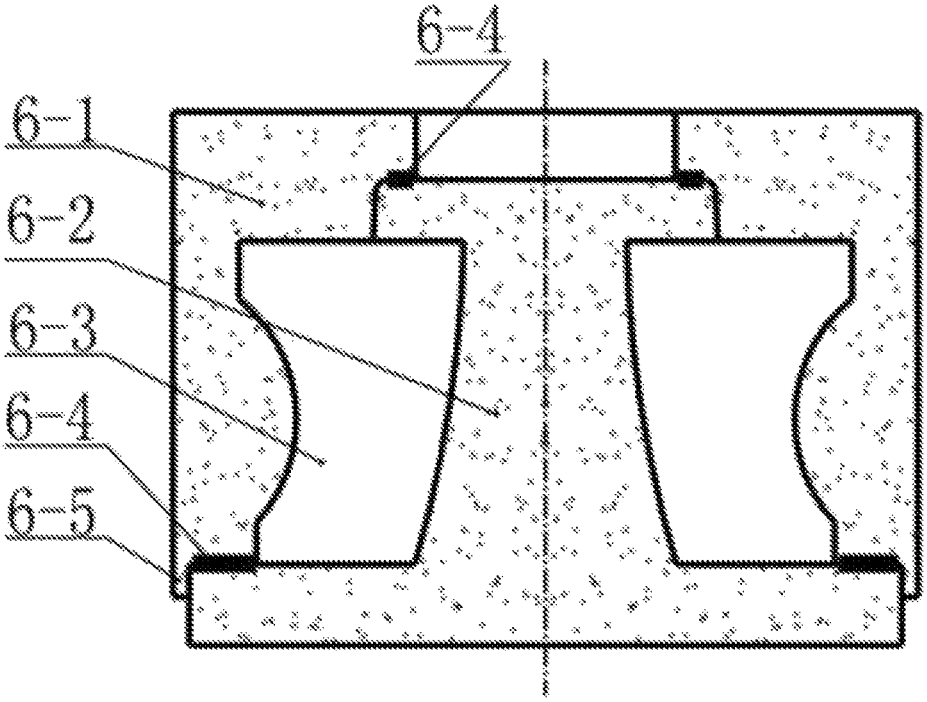
FIG. 6 is a cross-sectional schematic view of the inner cast mold and the outer cast mold in the single-metal roll cast mold, in FIG. 6, 6-1 is the outer cast mold; 6-2 is the inner cast mold; 6-3 is the cavity of the blank; 6-4 is the sealing device, and the 6-5 is the cast positioning device.

Referring to FIG. 6, another technical scheme of the present invention provides a single metallic material casting special-shaped roll. The casting special-shaped roll is also a curved surface of said roll is with large diameter of two ends of the roll and small mid diameter of the roll, and has a central hole along the central axis of the roll, which is realized by the following preparation method:

designing a blank having an outer curved surface, an upper end face, and a lower end face according to an outer curved surface, an upper end face, and a lower end face of a finished roll plus machining allowances, wherein:

according to the outer curved surface of the blank, a shape of a central hole of the blank is designed as an inner curved surface which bends inward and has a diameter that is gradually reduced from a bottom to a top of the central hole, and from the bottom to the top of the blank, section areas of the above two designs of the blank gradually increases or keeps uniform.

Casting mold design and casting of single metal material: providing a cast mold that is designed according to a shape of the outer curved surface and the central hole of the blank and the machining allowances, the cast mold comprises an inner cast mold 6-2 and an outer cast mold 6-1, the inner cast mold 6-2 is formed by an inner curved surface which is bent inward and has a diameter that is gradually reduced from the bottom to the top of the blank and a lower end face, the outer cast mold 6-1 is formed by an outer curved surface of blank which is bent inward and has a diameter that is gradually reduced from the bottom to the top of the blank and an upper end face. The molten single molten metal is poured into the cavity of the blank 6-3, which is formed by assembling the outer cast mold 6-1 and the inner cast mold 6-2, and positing and sealing it by the cast positioning device 6-5 and the sealing device 6-4. After the molten metal is solidified, the casting process of single metal casting special-shaped roll is finished. In the single-metal material casting special-shaped roll of the present invention, the cross-sectional areas of the blank and the central hole are gradually increased or keeps the consistent shape from bottom to top, which allows the progressive solidification during the casting and improves the casting quality of the curved surface shape of the roll body of single metal material is with a large diameter of two ends and a small mid diameter and reduces the casting defects.

After the casting is finished, the casting blanks of the special-shaped rolls formed by a composite casting method and the casting special-shaped rolls are subjected to the conventional processing, namely annealing, rough machining, appropriate heat treatment and finish machining to obtain the finished rolls, and the isothermal quenching heat treatment is carried out when the alloy nodular cast iron is adopted.

In order to increase the strength of the outer cast mold, a plurality of protruding iron pieces can be arranged on the inner wall of an iron-made sand box of the outer cast mold, so as to increase the connection strength of the sand box and a sand mold. The steel skeleton can also be provided in the outer sand mold to increase the strength of the sand mold. To increase the solidification rate, moderate graphite powder particles or magnesia powder is added to the cast mold, or a slight amount of tellurium powder is added in the coating.

The special shaped roll formed by a composite casting method in this present invention adopts a composite material with the outer layer which is made of high chromium cast iron and the inner layer which is made of cast steel, the advantages are that high chromium cast iron has good wear resistance, impact resistance, rapid heating and cooling action resistance and good hardenability, cast steel has high strength and high toughness, and both have the same or similarly casting shrinkage, which makes it possible to combine the inner layer and outer layer of the composite casting very well. The mass percentage of specific composition of the composite is as following:

For the high chromium cast iron: C: 2.0%~2.6%, Si: 0.2%~0.5%, Mn: 0.6%~1.0%, Cr: 11.0%~18.0%, Ni: 0.5%~1.5%, Mo: 0.5%~1.5%, W: 0.5%~1.5%, Zr: 0.1%~0.3%, Nb: 0.05%~0.15%, Ti: 0.05%~0.15%, RE: 0.05%~0.15%, P: ≤0.030%, S: ≤0.025%, the rest compositions are Fe and unavoidable impurities. The content of Mo+W+Zr is greater than or equal to 1.2% and less than or equal to 2.2% by mass percent; the content of Nb+Ti+RE is greater than or equal to 0.10% and less than or equal to 0.40% by mass percent. The mass percentage of Mo, W and Zr in total is greater than or equal to 1.2% and less than or equal to 2.2%, while the mass percentage of Nb, Ti and RE in total is greater than or equal to 0.10% and less than or equal to 0.40%. The inner layer of cast steel is cast carbon steel or low alloy cast steel.

Wherein, C and Cr are the most basic and important alloying elements in high chromium materials. The amount of its content determines the number of carbides, the relative amount of carbide $M_7C_3$ and the total carbide, the hardness and the toughness, and the hardenability of the material. Mo element enters into $Mo_2C$ about 50% of each phase of high chromium material, and about 25% enters into $M_7C_3$ carbide. It can effectively improve the hardness and wear resistance of materials. In addition, about 23% is dissolve into the matrix, and the hardenability of the material is obviously improved. The binding force of W atom and C atom is large, and the stability of decomposition of martensite at high temperature is improved, thus the red hardness is improved. During high temperature quenching, partial W carbide is dissolved into the matrix and the hardenability of the material is improved. The Ni element strengthens the matrix and improves the comprehensive properties of the material, and the hardenability could be improved. The addition of Zr can effectively improve the strength, hardness and red hardness of the materials. Ti can refine its eutectic structure and form a stable small nucleus of TiC. The addition of Nb can precipitate the hard phase Nb (CN) particles with high hardness (2000 HV), high melting point, shape regular and small granularity, and uniform distribution. It can effectively control the solidification segregation of alloy, improve its comprehensive performance, and play a role in saving Ni or Cr.

According to the specific high-chromium cast iron composition, the inner layer composition of cast steel can be made of conventional engineering cast carbon steel or low alloy cast steel. The special-shaped rolls made of the composite material composed of out layer of high chromium cast iron and the inner layer of cast steel are mainly used in the equipment such as pipe mill, cold bend section mill, steel pipe straightener and so on.

Another composite material used in the invention is an out layer of alloy nodular cast iron and inner layer of ductile cast iron. The isothermal quenched ductile cast iron has good wear resistance, impact resistance, rapid heating and cooling action resistance and good hardenability, cast steel has high strength and high toughness, and both have the same or similarly casting shrinkage. The mass percentage of specific composition of the composite is as following:

The mass percentage of out layer which is made of alloy nodular cast iron is: C: 3.0%~3.8%, Si: 1.4%~1.8%, Mn: ≤0.35%, Ni: ≤2.5%, Cu: 0.4%~1.0%, Mo: 0.3%~1.0%, Cr: 0.1%~0.3%, B: ≤0.08%, Mg: 0.04%~0.10%, Bi: 0.0004%~0.0005%, Sb: 0.0002%~0.0003%, P: ≤0.04%, S: ≤0.02%, the rest compositions are Fe and unavoidable impurities; Wherein, the mass percentage of Ni and Cu in total is greater than or equal to 0.4% and less than or equal to 2.5%, while the mass percentage of Cr and B in total is greater than or equal to 0.05% and less than or equal to 0.25%. The mass percentage of inner layer of ductile cast iron is: C: 3.0%~3.8%, Si: 2.2%~2.7%, Mn: 0.35%, Cu: 0.4%~0.6%, Mg: 0.04%~0.10%, P: ≤0.04%, S: ≤0.02%, the rest compositions are Fe and unavoidable impurities.

Wherein, in that alloy spheroidal graphite cast iron, C is a graphitization element, and when the content of C is raise, on the one hand, the precipitation of cementite is hindered, on the other hand, the number of graphite cores is increased, and the graphite can be refined, and the roundness of the graphite ball is improved. However, that content of C is too high and easy to form graphite float, and the content of C is too low that increase shrinkage tendency. Therefore, the C content which is selected as 3.0%~3.8% is suitable. Si can not only improve the eutectoid transition temperature, but also widen the temperature range of eutectoid transformation, shorten the incubation period of pearlite and bainite. The performance of bainite ductile iron increases with the increase of silicon content, and the increase of silicon content can make the spheric diameter of graphite be even fine, and silicon can promote bainite transformation, form fine acicular bainite, thus improve the comprehensive properties of acicular structure. However, when that amount of silicon is too high, it will promote the formation of ferrite, and therefore, Si is selected at 1.4%~1.8% according to specific condition of the roll. Mn is an anti-graphitization element, which is combined to form MnS and MnO with sulfur and oxygen in ductile iron of alloy. Therefore, the main function of Mn is to eliminate the harmful effects of sulfur and oxygen in molten iron. On the other hand, Mn is a very easy segregation element. In the state of incomplete isothermal quenching, the mixture of martensite and retained austenite will appear on the grain boundary of the eutectic colony. This kind of organization greatly deteriorates the plasticity of ductile iron. The practice has showed that a small amount of Mn is advantageous to stabilize and refine the spherical body, so Mn is set to ≤0.35%. The tendency of P to form regional segregation is large, especially in thick ductile iron. The production practice proves that the average P content reaches 0.1%, there will be 2%~3% of the eutectic of P. Because of its low melting point, the eutectic group that grows when solidified moves to the periphery of the eutectic. Therefore, the phosphorus eutectic eventually appeared on the grain boundary of the eutectic colony, and it was a polygonal hard eutectic phosphorus eutectic, which was easy to cause stress concentration, and thereby reduce the strength, plasticity and toughness of the material. Thus P is set to ≤0.04%. S is an anti-graphitization element, and high S inevitably consumes much of nodulizing agent because nodulizing element is strong desulfurizer, they are added first to desulfurization, and then play a role in nodulizing effects. It is proved that even adding magnesium, calcium, zirconium and rare earth elements when the content of S is higher, it is impossible to obtain better nodulizing effect, leading to performance degradation. The S content of ductile iron should be as low as possible, so S is set to ≤0.02%. Cr is one of the strongest carbide forming elements, and the number of carbides increases with the increase of Cr content, thus increasing the hardness and deepening the depth of the hard layer, thus increasing the abrasion resistance accordingly, when multi-component alloying at the same time by adding elements such as nickel and molybdenum, this phenomenon is very prominent. However, Cr is also an anti-graphitization element, and an excessively high Cr content affects the overall performance of nodulizing. That Cr is set to 0.1%~0.3% is suitable. B forms a high hardness boron carbide, which can remarkably improve the wear resistance of the alloy ductile iron, but B is also an anti-graphitization element, and B is set to ≤0.08% according to the experimental results. Considering the effects of Cr and B and the experimental results, the content of Cr+B is set to. ≤0.05% and ≤0.25% by mass percentage. Ni is the main alloying element to enlarge the γ phase and form and stabilize austenite. Ni does not form carbide with carbon, but is dissolved in iron to stabilize and refine the pearlitic structure. It is proved that Ni is effective in increasing the pearlite content in section ductile iron and improving the tensile strength of core. In practice, that combination of Ni and other alloy element can obtain better effect than when Ni is added separately. When the content of Ni is higher, bainite can be obtained stably, while the bainite is refined, and the plasticity and toughness of acicular iron structure can be remarkably improved. However, Ni is a rare precious metal, and the content of Ni is too high to increase the cost greatly, which makes the market difficult to accept, it should be determined according to the specific conditions of different roll service, so Ni is set to ≤2.5%. Cu promotes graphitization in the eutectic transformation, and its graphitization capacity is about 30% of silicon, which can reduce the critical temperature of austenite transformation and promote the formation of pearlite. It is beneficial to reduce or eliminate the free cementite, and greatly reduce the tendency of chill in the thin wall of castings, improve the toughness of the spheroidal graphite cast iron and strengthen and refine the ferrite in the pearlite and pearlite, thus improving the hardness and strength of the casting. When Cu is combined with Mo and Mn, it is better to improve hardenability. However, too high a Cu content tends to increase the tendency of the material to crack when operating in a hot state, and therefore, Cu is set at 0.4%~1.0%. Considering the effect of Ni and Cu and the experimental results, the content of Ni+Cu is set to ≥0.4% and ≤2.5% by mass percentage. Mo is a powerful pearlite forming agent, which has important influence on the basic structure of ductile iron. When the content of Mo in cast iron is more than 0.5%, the matrix is transformed all into pearlite. After increasing the content of Mo, the austenite decomposition of the alloy spheric iron is restrained and the acicular bainite structure is formed. Mo also belongs to rare precious metal. The high Mo content increases the cost greatly, which makes the market difficult to accept. It should be determined according to the specific service conditions of different rolls, so Mo is set to 0.3%-1.0%. The trace addition of Bi and Sb can effectively improve the nodulizing quality, especially for single heavy rolls, can obviously improve the nodulizing rate of graphite and improve the roundness of graphite nodule.

The special-shaped rolls produced by the composite material composed of out layer of alloy nodular cast iron and inner layer of ductile cast iron are mainly used in the sizing mill and reducing mill of the hot-rolled seamless steel pipe.

The invention relates to a steel pipe prepared by the invention and a special-shaped roll for cold-bend steel production. A simple and practical casting method is adopted, and the roll blank is changed into a structure for facilitating the casting sequence solidification by using the central hole of the roll, and the bimetal composite casting is realized by adopting double-cast mold casting. The method is simple and convenient and has good effect, the special-shaped roll at the same time is provided with a sufficiently thick working layer which is wear-resistant, impact-resistant and shock-resistant, and a high-intensity and high-toughness core part, and it is fully satisfied with the use requirement. Due to the low alloying of the core, not only the alloying elements of Cr, Ni, Mo, W are saved, but also the mechanical performance of the core are increased. The work layer of special-shaped roll adopts series of high chromium cast iron and alloy nodular cast iron, which satisfies the requirements of different service conditions in the production of steel pipe and cold bend mill. Similarly, the single metal casting special-shaped roll of the present invention has good sequence solidification during casting due to reasonable design, reduces casting defects, improves casting quality, and meets various performance requirements of rolling mill.

The steel pipe straightening roll, welded pipe and cold-formed steel roll prepared by the invention which working layer material is high-chromium cast iron, and the working performance reaches performance index of forging D2 (X155CrVMo12-1, SKD11) cold working die steel and forging H13 (X40CrMoV5-1, SKD61) hot working die steel similar roll. However, that material utilization ratio is more than 30% more than the forging, and the good effect of energy-saving materials is achieved.

Following that present invention will be described in more detail with reference to embodiments.

Referring to FIGS. 1 to 6, three to four metal frames are uniformly provided in the outer cast mold of the working layer of the roll to enhance the joint strength between sand box and sand mold in the following embodiments, and 5% to 10% of the graphite powder particles are added to the mold, and the coating is added with a slight amount of tellurium powder in common sense, which is used to improve the solidification rate of cast mold. A thickness of the outer layer of the blank plus machining allowance is increased by an extra 5 mm to 20 mm, and a weight ratio of the outer layer and the inner layer of the blank is equal to or more than 1.2:1. The conventional isothermal quenching heat treatment is carried out when the alloy nodular cast iron is used.

Embodiment 1

Referring to FIG. 1, FIG. 3, FIG. 4 and FIG. 5, the present embodiment is a heat treatment line straightener roll for manufacturing a Φ720 seamless steel pipe unit, each set of 6 pieces, adopting the composite material composed of the out layer which is made of high chromium cast iron and the inner layer which is made of cast steel. The existing forging 9Cr2MoV roll blank in the first comparative example is a free forged cylinder with a weight of about 8948 kg and a service life of 1 year. The blank weight of the complete copying machining allowance in the second comparative example is about 4681 kg.

The size of the finished product (FIG. 3) is as follows: the maximum diameter of upper and lower ends is Φ994 mm, the minimum diameter of middle is Φ880 mm, the inner hole is Φ480 mm, the height of roll is 1100 mm and the weight is 4060 kg/piece.

The blank design of this embodiment (FIG. 3) is as follows: the upper end of the outer surface which is designed according to the curved surface of finished product is Φ1034 mm, the middle minimum is Φ910 mm, the lower end is Φ1013 mm, and the lower end of the central hole is Φ471 mm, the upper end that gradually narrowed upward is Φ344 mm, the lower end of the division curved surface is Φ774 mm, and strict adherence to the diameter of the curved surface gradually decreases the smooth transition gradually from bottom to top is gradually reduced upward to the upper end of Φ665 mm and the outer layer weight is 2880 kg, the inner layer weight is 2235 kg.

According to the above-described dimensions, the double-outer mold casting mold is prepared, that is, the inner cast mold 4-2, the outer cast mold of the inner layer of the blank 4-1 (FIG. 4) and the outer cast mold of the outer layer of the blank 5-1 (FIG. 5) are produced. Referring to FIG. 4, the inner cast mold 4-2 and the outer cast mold of the inner layer of the blank 4-1 are assembled and sealed, so that the outer cast mold of the inner layer of the blank 4-1 and the inner cast mold 4-2 are assembled to form the cavity space of the inner layer of the blank 4-3; in that process of smelting the out layer which is made of high chromium cast iron material and the inner layer which is made of cast steel material by 2 electric furnaces simultaneously, the molten liquid of molten the inner layer which is made of cast steel is cast into the cavity space of the inner layer of the blank 4-3, and when the temperature measurer arranged in the casting mold is shown as 850° C., the outer cast mold of the inner layer of the blank 4-1 is removed and quickly installed with the outer cast mold of the outer layer of the blank 5-1, referring to FIG. 5, and then the molten liquid of out layer which is made of high chromium cast iron is poured into the cavity space of the outer layer of the blank 5-3, after solidification, the whole casting process of the special shaped roll is finished. Since the section area of the inner layer and the outer layer is gradually increased from the bottom up, the sequence of solidification is realized, so that a 100% qualified bimetal composite casting straightening roll blank is obtained. The obtained composite roll blank weighs 5115 kg per piece, is 57.1% of forging blank, the material utilization rate increased by 42.8%; the weight is 109% of the blank weight designed for full copying machining allowance. Not only 100% qualification rate is guaranteed. At the same time, the inner layer which is made of cast steel saves a lot of metal such as Cr, Ni, Mo, Zr, and reduces the production cost.

Conventional annealing, rough machining, heat treatment and finish machining are carried out on the cast finished special shaped roll blank to obtain finished roll. After testing, the chemical composition of the outer layer in percent by mass is C: 2.12%, Si: 0.40%, Mn: 0.78%, Cr: 16.10%, Ni: 1.15%, Mo: 1.30%, W: 0.5%, Zr: 0.30%, Nb: 0.10%, Ti: 0.08%, RE: 0.05%, P: 0.023%, S: 0.017%, the rest compositions are Fe and unavoidable impurities.

After testing and installation test, the hardness of roll working face is 56.5 HRC~57.6 HRC, the service life can be increased to more than 2 years. The comparison of the using effect of rolling the same steel pipe in this embodiment and 9Cr2MoV forged steel roll is shown in Table 1.

TABLE 1

| Comparison of wear resistance of straightening rolls | |
|---|---|
| Roll material and forming method | roll radius orientation wear 1 mm, the number of rolled steel pipes |
| 9Cr2MoV forged steel roll | 4800 |
| Casting special shaped rolls in the present invention | 10700 |

From the comparison of the wear resistance of the straightening rolls of Table 1, it can be seen that the casting special shaped rolls of the present invention are compared with the existing forged 9Cr2MoV rolls in one of the comparative examples, in the same situation where the roll radius direction is worn by 1 mm straightening amount, the amount of rolling is twice that above the service life has doubled. Meanwhile, the weight of the finished roll of this embodiment is 4060 kg per piece, and the roll weight of one of the comparative examples is about 8948 kg, which is more than doubled that of the present invention, and the roll weight of the second comparative example is 4681 kg, which is 621 kg heavier than that of the present embodiment. It illustrates that invention not only has long service life, but also saves a large amount of material.

Embodiment 2

Referring to FIG. 1, FIG. 3, FIG. 4 and FIG. 5, the present embodiment is a heat treatment line straightener roll for manufacturing a Φ250 seamless steel pipe unit, each set of 6 pieces, adopting the composite material composed of the out layer which is made of high chromium cast iron and the inner layer which is made of cast steel. The existing forging X155CrVMo12-1 roll blank in the first comparative example is a free forged cylinder with a weight of about 1530 kg. The blank weight of the complete copying machining allowance in the second comparative example is about 990 kg.

The size of the finished product is as follows: the maximum diameter of upper and lower ends is Φ572 mm, the minimum diameter of middle is Φ480 mm, the inner hole is Φ240 mm, the height of roll is 660 mm and the weight is 806 kg/piece.

The blank design of this embodiment (FIG. 3) is as follows: the upper end of the outer surface which is designed according to the curved surface of finished product is Φ612 mm, the middle minimum is Φ510 mm, the lower end is Φ592 mm, and the lower end of the central hole is Φ235 mm, the upper end that gradually narrowed upward is Φ148 mm, the lower end of the division curved surface is Φ436 mm, and strict adherence to the diameter of the curved surface gradually decreases the smooth transition gradually from bottom to top is gradually reduced upward to the upper end of Φ378 mm and the outer layer weight is 614 kg, the inner layer weight is 486 kg.

According to the above-described dimensions, the inner cast mold 4-2, the outer cast mold of inner layer 4-1 (FIG. 4) and the outer cast mold of the outer layer of the blank 5-1 (FIG. 5) are produced. Referring to FIG. 4, the inner cast mold 4-2 and the outer cast mold of the inner layer of the blank 4-1 are assembled and sealed, so that the outer cast mold of the inner layer of the blank 4-1 and the inner cast mold 4-2 are assembled to form the cavity space of the inner layer of the blank 4-3 (FIG. 4); in that process of smelting the out layer which is made of high chromium cast iron material and the inner layer which is made of cast steel material by 2 electric furnaces simultaneously, the molten liquid of molten inner layer which is made of cast steel is cast into the cavity space of the inner layer of the blank 4-3 (FIG. 4), and when the temperature measurer arranged in the casting mold is shown as 950° C., the outer cast mold of the inner layer of the blank 4-1 (FIG. 4) is removed and quickly installed with the outer cast mold of outer layer 5-1 (FIG. 5), and then the molten liquid of the out layer which is made of high chromium cast iron is poured into the cavity space of the outer layer of the blank 5-3 (FIG. 5), the whole casting process of the straightener special shaped roll is finished. Since the section area of the inner layer and the outer layer of this embodiment is reasonable in cross-section design, the sequence of solidification is realized, so that a qualified composite casting straightener roll blank is obtained. The roll blank weighs 1100 kg per piece, is 71.9% of forging blank, the material utilization rate increased by 28.1%; the weight is 111% of the blank weight designed for full copying machining allowance. And 100% qualification rate is guaranteed. The inner layer which is made of cast steel saves a lot of alloy material and reduces the production cost.

The conventional processing technology of special-shaped roll blank is used to obtain finished roll. The chemical composition of the outer layer of rolls in percent by mass is C: 2.20%, Si: 0.38%, Mn: 0.68%, Cr: 17.10%, Ni: 1.25%, Mo: 1.00%, W: 1.00%, Zr: 0.20%, Nb: 0.15%, Ti: 0.10%, RE: 0.10%, P: 0.023%, S: 0.017%, the rest compositions are Fe and unavoidable impurities.

The hardness of roll working face is 56.8 HRC~57.4 HRC, after installation test, compared with X155CrVMo12-1 forged steel roll, rolling the same steel pipe in this embodiment is better than forged steel. Performance comparison is shown in Table 2.

TABLE 2

| Comparison of wear resistance of straightening rolls | |
|---|---|
| Roll material and forming method | roll radius orientation wear 1 mm, the tons of rolled steel pipes |
| X155CrVMo12-1 forged steel roll | 10000 tons |
| Casting special shaped rolls in the present invention | 12000 tons |

From the comparison of the wear resistance of the straightening rolls of Table 2, it can be seen that the casting special shaped rolls of the present invention are compared with the existing forged X155CrVMo12-1 roll in one of the comparative examples, in the same situation where the roll radius direction is worn by 1 mm straightening amount, the amount of rolling has increased by 2000 tons. Meanwhile, the weight of the finished roll of this embodiment is 806 kg per piece, and the roll weight of one of the comparative examples is about 1530 kg, which is nearly doubled that of the present invention, and the roll weight of the second comparative example is 990 kg, which is 200 kg heavier than that of the present embodiment. It illustrates that invention not only saves material but also produce high productivity.

Embodiment 3

Referring to FIG. 2, FIG. 3, FIG. 4 and FIG. 5, the present embodiment is a Φ406 welded steel tube fine forming roll, each set of 2 pieces, adopting the composite material composed of the out layer which is made of high chromium cast iron and the inner layer which is made of cast steel. The existing forging X155CrVMo12-1 roll which the forging roll blank is a free forged cylinder with a weight of about 3180 kg.

The size of the finished product is as follows: the maximum diameter of upper and lower ends is Φ926 mm, the minimum diameter of middle is Φ720 mm, the inner hole is Φ340 mm, the height of roll is 530 mm and the weight is 1657 kg/piece.

In this embodiment, the upper end of the outer surface which is designed according to the curved surface of finished product is Φ966 mm, the middle minimum is Φ750 mm, the lower end is Φ946 mm, and the lower end of the central hole is Φ334 mm, the upper end that gradually narrowed upward is Φ255 mm, the lower end of the division curved surface is Φ644 mm, and strict adherence to the diameter of the curved surface gradually decreases the smooth transition gradually from bottom to top is gradually reduced upward to the upper end of Φ598 mm and the outer layer weight is 1262 kg, the inner layer weight is 909 kg.

In this embodiment, according to the above-described dimensions, the inner cast mold 4-2, the outer cast mold of the inner layer of the blank 4-1 (FIG. 4) and the outer cast mold of the outer layer of the blank 5-1 (FIG. 5) are produced. Referring to FIG. 4, the inner cast mold 4-2 and the outer cast mold of the inner layer of the blank 4-1 are assembled and sealed, the cavity space of the inner layer of the blank 4-3 (FIG. 4) is formed after assembly; smelting out layer which is made of high chromium cast iron material and the inner layer which is made of cast steel material simultaneously, the molten liquid of molten inner layer of cast steel is cast into the cavity space of the inner layer of the blank 4-3, and when the temperature measurer arranged in the casting mold is shown as 900° C., the outer cast mold of the inner layer of the blank 4-1 is removed and quickly installed with the outer cast mold of the outer layer of the blank 5-1, and then the molten liquid of the out layer which is made of high chromium cast iron is poured into the cavity space of the outer layer of the blank 5-3 (FIG. 5), the whole casting process of the special shaped roll is finished. In the casting process, this embodiment completely realizes the sequence solidification and obtains the qualified roll blank. The roll blank weighs 2171 kg per piece, is 68.3% of forging blank, the material utilization rate increased by 31.7%; the weight is 108% of the blank weight designed for full copying machining allowance. And 100% qualification rate is guaranteed. The inner layer which is made of cast steel saves a lot of alloy material and reduces the production cost.

The machining processing technology and heat treatment of special-shaped roll blank is used to obtain finished roll. The chemical composition of the outer layer of rolls in percent by mass is C: 2.59%, Si: 0.21%, Mn: 0.63%, Cr: 17.90%, Ni: 1.45%, Mo: 1.40%, W: 0.50%, Zr: 0.15%, Nb: 0.15%, Ti: 0.05%, RE: 0.10%, P: 0.024%, S: 0.013%, the rest compositions are Fe and unavoidable impurities.

After testing and installation test, the hardness of roll working face is 59.8 HRC~60.4 HRC, when the roll radius direction is worn by 1 mm, the welded pipe is 150 thousand tons, reaching the roll level of forged X155 CrVMo12-1.

Embodiment 4

Referring to FIG. 2, FIG. 3, FIG. 4 and FIG. 5, the present embodiment is a Φ147 welded steel tube fine forming roll, each set of 2 pieces, adopting the composite material composed of the out layer which is made of high chromium cast iron and the inner layer which is made of cast steel. The existing forging X155CrVMo12-1 roll which the forging roll blank is a free forged cylinder with a weight of about 510 kg.

The size of the finished product is as follows: the maximum diameter of upper and lower ends is Φ576 mm, the minimum diameter of middle is Φ520 mm, the inner hole is Φ280 mm, the height of roll is 210 mm and the weight is 261 kg/piece. In this embodiment, the size of the blank is as follows: the upper end of the outer surface which is designed according to the curved surface of finished product is Φ595 mm, the middle minimum is Φ540 mm, the lower end is Φ595 mm, and the lower end of the central hole is Φ278 mm, the upper end that gradually narrowed upward is Φ211 mm, the lower end of the division curved surface is Φ436 mm, and the diameter of the curved surface gradually decreases the smooth transition gradually from bottom to top is gradually reduced upward to the upper end of Φ379 mm and the outer layer weight is 231 kg, the inner layer weight is 139 kg.

In this embodiment, according to the above-described dimensions, the inner cast mold 4-2, the outer cast mold of the inner layer of the blank 4-1 (FIG. 4) and the outer cast mold of the outer layer of the blank 5-1 (FIG. 5) are produced. Referring to FIG. 4, the inner cast mold 4-2 and the outer cast mold of the inner layer of the blank 4-1 are assembled and sealed, so that the outer cast mold of the inner layer of the blank 4-1 and the inner cast mold 4-2 are assembled to form the blank inner layer cavity 4-3 (FIG. 4); smelting the out layer which is made of high chromium cast iron material and the inner layer which is made of cast steel material simultaneously, the molten liquid of molten inner layer of cast steel is cast into the cavity space of the inner layer of the blank 4-3, and when the temperature measurer arranged in the casting mold is shown as 900° C., the outer cast mold of the inner layer of the blank 4-1 is removed and quickly installed with the outer cast mold of the outer layer of the blank 5-1, and then the molten liquid of the out layer which is made of high chromium cast iron is poured into the cavity space of the outer layer of the blank 5-3 (FIG. 5), the whole casting process of the special shaped roll is finished. In the casting process, this embodiment completely realizes the sequence solidification and obtains the qualified roll blank. The roll blank weighs 370 kg per piece, is 72.5% of forging blank, the material utilization rate increased by 27.5%; the weight is 104% of the blank weight designed for full copying machining allowance. But the quality is much better than the full copying design blank. The inner layer which is made of cast steel saves a lot of alloy material and reduces the production cost.

Conventional annealing, rough machining, heat treatment and finish machining and other process are carried out on the cast finished special shaped roll blank to obtain finished roll. The chemical composition of the outer layer in percent by mass is C: 2.60%, Si: 0.49%, Mn: 0.93%, Cr: 11.20%, Ni: 0.51%, Mo: 1.0%, W: 0.8%, Zr: 0.30%, Nb: 0.05%, Ti: 0.15%, RE: 0.05%, P: 0.020%, S: 0.014%, the rest compositions are Fe and unavoidable impurities.

After testing and installation test, the hardness of roll working face is 58.2 HRC~61.1 HRC, when the roll radius direction is worn by 1 mm, the welded pipe is 100 thousand tons, which is equivalent to that of the forged X155CrVMo12-1 roll level.

Embodiment 5

Referring to FIG. 2, FIG. 3, FIG. 4 and FIG. 5, this embodiment is a Φ340 hot-rolled seamless steel pipe sizing mill roll, using the composite material composed of the out layer which is made of alloy nodular cast iron and the inner layer which is made of ductile cast iron. The existing rolls are cast Ni3Mo1 ductile iron rolls, the heat treatment process is the normalizing, and the actual dissection detection impact toughness is 30 KJ/m$^2$.

The size of the finished product is as follows: the maximum diameter of upper and lower ends is Φ641 mm, the minimum diameter of middle is Φ534 mm, the inner hole is Φ190 mm, the height of roll is 420 mm and the weight is 660 kg/piece. In this embodiment, the size of the blank is as follows: the upper end of the outer surface which is designed according to the curved surface of finished product is Φ661 mm, the middle minimum is Φ554 mm, the lower end is Φ661 mm, and the lower end of the central hole is Φ193 mm, the upper end that gradually narrowed upward is Φ134 mm, the lower end of the division curved surface is Φ417 mm, and strict adherence to the diameter of the curved surface gradually decreases the smooth transition gradually from bottom to top is gradually reduced upward to the upper end of Φ358 mm and the outer layer weight is 540 kg, the inner layer weight is 313 kg.

According to the above-described dimensions, the inner cast mold 4-2, the outer cast mold of the inner layer of the blank 4-1 (FIG. 4) and the outer cast mold of the outer layer of the blank 5-1 (FIG. 5) are produced. Referring to FIG. 4, the inner cast mold 4-2 and the outer cast mold of the inner layer of the blank 4-1 are assembled and sealed, so that the cavity space of the inner layer of the blank 4-3 (FIG. 4) is formed; smelting alloy nodular cast iron and ductile cast iron simultaneously, the molten liquid of molten ductile cast iron is cast into the cavity space of the inner layer of the blank 4-3, and when the temperature measurer arranged in the casting mold is shown as 920° C., the outer cast mold of the inner layer of the blank 4-1 is removed and quickly installed with the outer cast mold of the outer layer of the blank 5-1, and then the molten liquid of the out layer which is made of alloy nodular cast iron is poured into the cavity space of the outer layer of the blank 5-3 (FIG. 5), the whole casting process of the hot-rolled seamless steel pipe sizing mill roll blank is finished. In the casting process, this embodiment completely realizes the sequence solidification and obtains the qualified roll blank. The roll blank weighs 853 kg per piece, the weight is 108% of the blank weight designed for full copying machining allowance. But the quality is much better than the full copying design blank. At the same time, each casting of the inner layer which is made of cast iron can save 9 kg of Ni and 3 kg of Mo, which reduces the material cost.

The finished roll blank is subjected to annealing, rough machining, isothermal quenching heat treatment and finishing. The chemical composition of the outer layer of the finished roll in percent by mass is C: 3.65%, Si: 1.72%, Mn: 0.30%, Ni: 2.0%, Cu: 0.4%, Mo: 0.70%, Cr: 0.10%, B: 0.05%, Mg: 0.06%, Bi: 0.0004%, Sb: 0.0002%, P: 0.03%, S: 0.015%, the rest compositions are Fe and unavoidable impurities. The chemical composition of the inner layer in percent by mass is C: 3.2%, Si: 2.55%, Mn: 0.34%, Cu: 0.4%, Mg: 0.06%, P: 0.023%, S: 0.017%, the rest compositions are Fe and unavoidable impurities.

After isothermal quenching, the working surface hardness of the roll is 66HS~68HS, and the actual dissection detection impact toughness is 100KJ/m$^2$. After installation test, the radial direction of rolls is worn by 1 mm and the number of rolling steel pipe is 8000. The radial direction of existing casting Ni3Mo1 ductile cast iron is worn by 1 mm and the quantity of the same steel pipe which can be rolled is 7000. Under the same condition, in this embodiment, the rolling amount of 1000 steel pipe is improved more than that of the existing cast Ni3Mo1 ductile cast iron roll.

Embodiment 6

Referring to FIG. 2, FIG. 3, FIG. 4 and FIG. 5, the present embodiment is a Φ250 hot-rolled seamless steel pipe sizing mill roll, adopting the composite material composed of the out layer which is made of high chromium cast iron and the inner layer which is made of cast steel. The existing roll is cast Ni3Mo1 ductile cast iron roll.

The size of the finished product is as follows: the maximum diameter of upper and lower ends is Φ484 mm, the minimum diameter of middle is Φ420 mm, the inner hole is Φ160 mm, the height of roll is 265 mm and the weight is 241 kg/piece. In this embodiment, the size of the blank is as follows: the upper end of the outer surface which is designed according to the curved surface of finished product is Φ498 mm, the middle minimum is Φ436 mm, the lower end is Φ498 mm, and the lower end of the central hole is Φ168 mm, the upper end that gradually narrowed upward is Φ111 mm, the lower end of the division curved surface is Φ322 mm, and the diameter of the curved surface gradually decreases the smooth transition gradually from bottom to top is gradually reduced upward to the upper end of Φ284 mm and the outer layer weight is 204 kg, the inner layer weight is 109 kg.

According to the above-described dimensions, the inner cast mold 4-2, the outer cast mold of the inner layer of the blank 4-1 (FIG. 4) and the outer cast mold of the outer layer of the blank 5-1 (FIG. 5) are produced. Referring to FIG. 4, the inner cast mold 4-2 and the outer cast mold of the inner layer of the blank 4-1 are assembled and sealed, so that the cavity space of the inner layer of the blank 4-3 (FIG. 4) is formed; smelting the out layer which is made of high chromium cast iron and the inner layer which is made of cast steel simultaneously, the molten liquid of molten inner layer of cast steel is cast into the cavity space of the inner layer of the blank 4-3, and when the temperature measurer arranged in the casting mold is shown as 910° C., the outer cast mold of the inner layer of the blank 4-1 is removed and quickly installed with the outer cast mold of the outer layer of the blank 5-1, and then the molten liquid of the out layer which is made of high chromium cast iron is poured into the cavity space of the outer layer of the blank 5-3 (FIG. 5), the whole casting process of the hot-rolled seamless steel pipe sizing mill roll blank is finished. In this embodiment, the roll blank weighs 313 kg per piece, the weight is 109% of the blank weight designed for full copying machining allowance. But 100% qualification rate is guaranteed, and the quality is better than the full copying design blank.

After testing the finished roll, the chemical composition of the outer layer of the roll in percent by mass is C: 2.10%, Si: 0.21%, Mn: 0.65%, Cr: 18.00%, Ni: 1.50%, Mo: 0.50%, W: 1.10%, Zr: 0.30%, Nb: 0.05%, Ti: 0.05%, RE: 0.10%, P: 0.020%, S: 0.014%, the rest compositions are Fe and unavoidable impurities. After testing, the hardness of roll working face is 73HS~77HS. After installation test, the comparison of service life of roll in this embodiment and existing ductile iron roll by rolling with the same steel tube which ranges from using to repairing period are shown in Table 3.

TABLE 3

| Comparison of the service life of roll in the present invention and ductile iron rolls | |
|---|---|
| Roll material and forming method | The quantity of steel pipes from use to repair |
| Imported ductile iron roll | 6000 |
| Domestic ductile iron roll | 4000 |
| Composite casting roll in present invention | 12000 |

The production effect of the composite casting special shaped roll of this embodiment in the table is two times and more than twice that of the first two rolls.

Embodiment 7

Referring to FIG. 2, FIG. 3, FIG. 4 and FIG. 5, this embodiment is a four-roll type sizing mill roll for a Φ720 hot-rolled seamless steel pipe, and the four-roll sizing mill is a new unit, and is the world's largest hot-rolled seamless steel pipe sizing mill roll. It belongs to super-thick ductile cast iron. It is difficult to cast and heat treatment. It adopts the composite material composed of the out layer which is made of alloy nodular cast iron and the inner layer which is made of ductile cast iron.

The size of the finished product is as follows: the maximum diameter of upper and lower ends is Φ1160 mm, the minimum diameter of middle is Φ1108 mm, the inner hole is Φ330 mm, the height of roll is 400 mm and the weight is 2495 kg/piece.

The blank design of this embodiment is as follows: the upper end of the outer surface which is designed according to the curved surface of finished product is Φ1194 mm, the middle minimum is Φ1141 mm, the lower end is Φ1194 mm, and the lower end of the central hole is Φ366 mm, the upper end that gradually narrowed upward is Φ277 mm, the lower end of the division curved surface is Φ730 mm, and the diameter of the curved surface gradually decreases the smooth transition gradually from bottom to top is gradually reduced upward to the upper end of Φ676 mm and the outer layer weight is 2060 kg, the inner layer weight is 1090 kg.

According to the above-described dimensions, the inner cast mold 4-2, the outer cast mold of the inner layer of the blank 4-1 (FIG. 4) and the outer cast mold of the outer layer of the blank 5-1 (FIG. 5) are produced. Referring to FIG. 4, the inner cast mold 4-2 and the outer cast mold of the inner layer of the blank 4-1 are assembled and sealed, so that the cavity space of the inner layer of the blank 4-3 (FIG. 4) is formed; in that process of smelting alloy nodular cast iron and ductile cast iron by 2 electric furnaces simultaneously, the molten liquid of molten ductile cast iron is cast into the cavity space of the inner layer of the blank 4-3, and when the temperature measurer arranged in the casting mold is shown as 880° C., the outer cast mold of the inner layer of the blank 4-1 is removed and quickly installed with the outer cast mold of the outer layer of the blank 5-1, and then the molten liquid of the out layer which is made of alloy nodular cast iron is poured into the cavity space of the outer layer of the blank 5-3 (FIG. 5), the whole casting process of the sizing mill roll blank is finished. The blank weight of the composite roll obtained is 3150 kg per piece, which is equal to the design weight of the cast blank of full copying machining allowance, and 100% qualification rate is guaranteed, while each casting of the inner layer ductile cast iron saves 33 kg of Ni and 11 kg of Mo, saves raw materials and reduces production costs.

The finished roll blank is subjected to annealing, rough machining, heat treatment and finishing and other process, and finished roll is obtained. The chemical composition of the outer layer of the finished roll in percent by mass is C: 3.80%, Si: 1.41%, Mn: 0.25%, Ni: 2.05%, Cu: 0.4%, Mo: 1.00%, Cr: 0.20%, B: 0.03%, Mg: 0.06%, Bi: 0.0004%, Sb: 0.0002%, P: 0.03%, S: 0.015%, the rest compositions are Fe and unavoidable impurities. The chemical composition of the inner layer in percent by mass is C: 3.75%, Si: 2.20%, Mn: 0.30%, Cu: 0.50%, Mg: 0.06%, P: 0.023%, S: 0.017%, the rest compositions are Fe and unavoidable impurities.

After isothermal quenching, the working surface hardness of the roll is 65HS~69HS. After installation test, the radial direction of rolls is worn by 1 mm and the number of rolling steel pipe is 7000, which met the design requirements.

Embodiment 8

Referring to FIG. 1 and FIG. 6, the present embodiment is a single metal material straightener roll for a Φ89 seamless steel pipe, each set of 6 pieces, adopting the composite material composed of high chromium cast iron material. The existing forging X155CrVMo12-1 roll which the forging roll blank is a free forged cylinder with a weight of about 427 kg. Since the roll needs to be repaired more than 6 times in use, the repair capacity is about 5 mm each time, while the roll itself is small in size and weight, so that a single metal material is adopted.

The size of the finished product is as follows: the maximum diameter of upper and lower ends is Φ342 mm, the minimum diameter of middle is Φ297 mm, the inner hole is Φ165 mm, the height of roll is 440 mm and the weight is 172 kg/piece. In this embodiment, the size of the blank is as follows: the upper end of the outer surface which is designed according to the curved surface of finished product is Φ361 mm, the middle minimum is Φ317 mm, the lower end is Φ361 mm, and the lower end of the central hole is Φ157 mm, and the diameter of the camber surface gradually decreases the smooth transition gradually from bottom to top is gradually reduced upward to the upper end of Φ119 mm.

In this embodiment, according to the above-described dimensions, the inner cast mold 6-2 (FIG. 6), the outer cast mold 6-1 (FIG. 6). Referring to FIG. 6, the inner cast mold 6-2 and the outer cast mold 6-1 are assembled, and the molten high chromium cast iron melting liquid is poured into the cavity space of the blank 6-3. After solidification of the metal solution in the cavity space of the blank 6-3, the outer cast mold 6-1 is removed and the casting process of the special-shaped roll is finished.

In the casting process, this embodiment completely realizes the sequence solidification and obtains the qualified roll blank. The roll blank weighs 256 kg per piece, is 60% of forging blank, the material utilization rate increased by 40%; the alloy material is saved, and the production cost is reduced.

Conventional annealing, rough machining, heat treatment and finish machining and other process are carried out on the cast finished special shaped roll blank to obtain finished roll. The chemical composition of the roll in percent by mass is C: 2.38%, Si: 0.35%, Mn: 0.91%, Cr: 17.90%, Ni: 1.2%, Mo: 0.89%, W: 1.1%, Zr: 0.1%, Nb: 0.015%, Ti: 0.10%, RE: 0.08%, P: 0.030%, S: 0.018%, the rest compositions are Fe and unavoidable impurities.

The working surface hardness of the finished products is 58.2 HRC~59.9 HRC. During the actual production process after installation, the radial direction of rolls is worn by 1 mm, and the seamless steel pipe is rolled 28000 tons, which is 1.15 times of forging X155CrVMo12-1 roll.

The above embodiment of the present invention has been practically used. The results of actual application and data comparison show that the special-shaped roll formed by a composite casting method and the casting special shaped roll prepared by using the two casting methods of the present invention have greatly improved performance. The present invention has a high strength, a high toughness, a high abrasion resistance, and a good impact resistance. The service life of the roll is greatly improved, and the production and maintenance cost is reduced, and the production efficiency is improved. Meanwhile, the invention saves a large amount of metal material from the blank and the mold design to the casting process, and also reduces the processing cost, and produces good economic benefits and energy-saving and material-saving effects.

The invention claimed is:

1. A preparation process for a special-shaped roll that (i) has a shape of a curved surface with a larger diameter at ends of the special-shaped roll and a smaller diameter at a middle of the special-shaped roll, (ii) is made of two composites, and (iii) is formed by a composite casting method, the process comprising:

designing a blank having an outer curved surface, an upper end face, and a lower end face according to an outer curved surface, an upper end face, and a lower end face of a finished roll plus machining allowances, wherein:

according to the outer curved surface of the blank, a shape of a central hole of the blank is designed as an inner curved surface which bends inward and has a diameter that is gradually reduced from a bottom to a top of the central hole, the blank is designed as two parts that constitute an inner layer of the blank and an outer layer of the blank, a shape of a composite combination layer of the outer layer of the blank and the inner layer of the blank has an inner curved surface which is bent inward and has a diameter that is gradually reduced from a bottom to a top of the composite combination layer, and from a bottom to a top of the blank, a section area of the inner layer of the blank and the outer layer of the blank gradually increases or keeps uniform while a diameter of a division curved surface at an intersection of the inner layer of the blank and the outer layer of the blank gradually decreases with a smooth transition;

providing a cast mold that is designed according to a shape of the outer curved surface and the central hole of the blank and the machining allowances, wherein:

the cast mold comprises an inner cast mold and an outer cast mold, the outer cast mold comprises an outer cast mold of the inner layer of the blank and an outer cast mold of the outer layer of the blank, a cavity space of the inner layer of the blank formed by combination of the inner cast mold and the outer cast mold of the inner layer of the blank is designed according to a shape and size of the inner layer of the blank, and a composite combination layer cavity space formed by combination of the outer cast mold of the outer layer of the blank and the inner cast mold is designed according to a shape and size of a combination of the inner layer of the blank and the outer layer of the blank;

separately smelting two kinds of molten metal for the inner layer of the blank and the outer layer of the blank at the same time;

firstly assembling the outer cast mold of the inner layer of the blank and the inner cast mold by sleeving the outer cast mold of the inner layer of the blank onto the inner cast mold from above down to form the cavity space of the inner layer of the blank, and sealing the cavity space of the inner layer of the blank;

then pouring molten metal of the inner layer of the blank into the cavity space of the inner layer of the blank;

after solidification of the molten metal of the inner layer of the blank, moving the outer cast mold of the inner layer of the blank away and rapidly mounting the outer cast mold of the outer layer of the blank to form a cavity of the outer layer of the blank and sealing the cavity of the outer layer of the blank, then pouring the molten metal of the outer layer of the blank into the cavity of the outer layer of the blank;

after the molten metal of the outer layer of the blank solidifies, moving the outer cast mold of the outer layer of the blank away; and carrying out machining and heat treatment processes to the blank.

2. The preparation process according to claim 1, wherein a thickness of the outer layer of the blank plus machining allowance is increased by an extra 5 mm to 20 mm, and a weight ratio of the outer layer of the blank and the inner layer of the blank is equal to or more than 1.2:1.

3. The preparation process according to claim 1, wherein a metal solidification temperature is maintained at 850° C.~950° C. when the outer cast mold of the inner layer of the blank is removed.

4. The preparation process according to claim 1, wherein the two composites are:

high chromium cast iron for the outer layer of the blank and cast steel for the inner layer of the blank, or alloy nodular cast iron for the outer layer of the blank and ductile cast iron for the inner layer of the blank; and isothermal quenching heat treatment is carried out when the alloy nodular cast iron is adopted.

5. The preparation process according to claim 1, wherein a plurality of metal frames are provided in the outer cast mold of the outer layer of the blank to enhance a joint strength between a sand box and a sand mold of the cast mold.

6. The preparation process according to claim 1, wherein an amount of moderate graphite powder particles or magnesia powder is added to the cast mold, and an amount of tellurium powder is added to a coating of the cast mold to improve a solidification rate of the cast mold.

* * * * *